United States Patent [19]

Waring

[11] 4,144,778

[45] Mar. 20, 1979

[54] TOOL FOR LIFTING A LATCH OPERATOR OF A LOCKED VEHICLE DOOR

[76] Inventor: Ben Waring, 3230 Crystal Ct., Miami, Fla. 33133

[21] Appl. No.: 885,809

[22] Filed: Mar. 13, 1978

[51] Int. Cl.[2] ..... E05B 63/00

[52] U.S. Cl. ..... 81/3 R; 70/465

[58] Field of Search ..... 81/3 R; 24/205 R; 70/394, 465

[56] References Cited

U.S. PATENT DOCUMENTS

| | | | |
|---|---|---|---|
| 2,907,237 | 10/1959 | Casas | 81/3 R |
| 3,340,750 | 9/1967 | Noorlun | 81/3 R |
| 3,438,290 | 4/1969 | Konopacki | 81/3 R |
| 3,664,211 | 5/1972 | McConnell | 81/3 R |

*Primary Examiner*—James L. Jones, Jr.
*Assistant Examiner*—James G. Smith

[57] ABSTRACT

A tool for lifting a latch operator of a locked vehicle door which tool is composed of a strip of spring steel bent back upon itself defining a first long operator leg and a second normally diverging shorter latch manipulator leg; the tool is adapted to be inserted, bent end first, between an automobile window and door with the legs in generally parallel relation and pushed downwardly until the upper end of the shorter latch manipulator leg is beneath the latch operator of a locked door and the spring steel will spring outwardly into engagement with the latch operator for lifting it upwardly to unlock it by lifting the longer operator leg and by so doing lifting the shorter leg and with it the latch operator; a string is connected to the end of the shorter leg for pulling it back into generally parallel alignment with the operator leg after the door has been unlocked, so that the tool can be readily removed from the door after it is unlocked.

3 Claims, 3 Drawing Figures

TOOL FOR LIFTING A LATCH OPERATOR OF A LOCKED VEHICLE DOOR

FIELD OF THE INVENTION

This invention relates to a tool for unlocking a locked vehicle door by lifting the latch operator.

BACKGROUND OF THE INVENTION

As is perhaps well known, persons often lose their keys or for any of a number of reasons do not have them available when desired. Also, parking lot attendants are often confronted with the problem of a person who has locked their car and taken their keys while the parking lot attendant was busy parking another vehicle. For this reason, it is desirable to have a tool which is adapted to quickly and easily unlock a vehicle door from the outside. This invention is of such a tool; and it is simple and inexpensive to manufacture and is composed of a single bendable part and, preferably, a tether string for moving the bendable parts into parallel relation and wherein, in the normal attitude, the tool diverges into two legs, a longer leg and a shorter leg, and which tool is adapted to be inserted between the windowpane and the vehicle door about the windowpane to manipulate a latched door lock operator.

It is, accordingly, a general object of this invention to provide an improved tool for use in unlocking a door from the outside of a vehicle by manipulating the latch operator. The tool comprises a strip of spring steel bent back upon itself forming a longer leg and a shorter leg; and in a normal attitude the legs diverge from one another and a string is provided for pulling the shorter leg into generally parallel relation with the longer leg for insertion and removal between a car window and locked car door and wherein, when in a normal position, the shorter leg is adapted to be manipulated by the longer leg from a position exteriorly of the car into and out of engaged relation with the underside of a door latch operator for lifting it from a locked position to unlock a vehicle door.

In accordance with these and other objects which will become apparent hereinafter, the instant invention will now be described with reference to the accompanying drawings, in which:

DESCRIPTION OF THE PREFERRED EMBODIMENT

Figure 2:
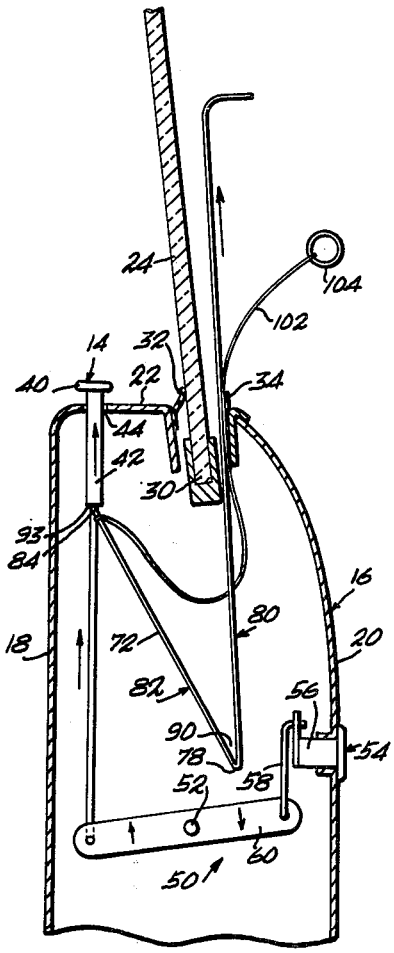
FIG. 2 is a view partly in cross section and illustrating a door, windowpane and latch operator of a vehicle and illustrating the tool in use for unlocking a door.

Referring to the drawings wherein like reference characters designate like or corresponding parts throughout the several views, there is shown a tool generally designated by the numeral 12 which is for the purpose of lifting a latch operator 14 which is conventionally used to unlock or lock a vehicle door generally designated by the numeral 16. The door is characterized by an inside surface 18 and an outside surface 20 and it is provided with a conventional window cut-out or opening defining a cut-out surface including a lower surface 22. A windowpane 24 is slidable in a slit 26 into and out of closing relation of the cut-out and the door is provided with internal guide track means for the windowpane as is conventional manner. The lower edge 30 of the windowpane is provided with window edge holding means and seal means 32 and 34 in wiping engagement of the opposite surfaces of the windowpane. In operation the lower edge of the window is at all times between the door surfaces and below the lower surface of the window cut-out; and, is conventional, the window is constrained to sliding movement through the slit into and out of closing relation of the window opening. Also, as is conventional, the latch operator may include an enlarged head 40, and a stem 42 which extends through an opening 44 of the lower surface of the cut-out. The latch operator is for the purpose of operating a conventional latch mechanism generally designated by the numeral 50 which is pivotally mounted on an axis indicated by the numeral 52. A lock cylinder 54 and barrel 56 cooperating therewith is also provided and, additionally, there is a link mechanism 58 comprising an arm which extends to a lever 60 which is swingable between the position shown in FIG. 2, that is a locked position to the position shown in FIG. 3, which is an unlocked position for transmitting force through a force transmitting rod 62 upon rotation of the cylinder to operate the linkage by lifting it and moving the element 60 pivotally as indicated by the arrowed lines in the drawings.

Figure 1:
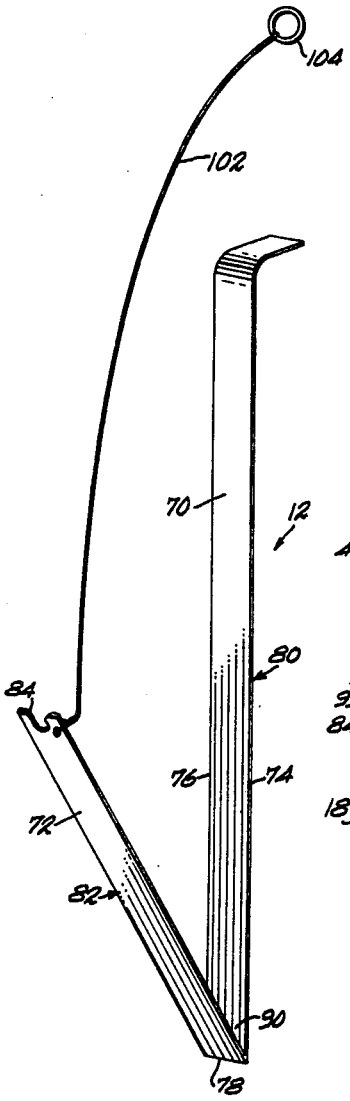
FIG. 1 is a perspective view of the instant invention.
Figure 3:
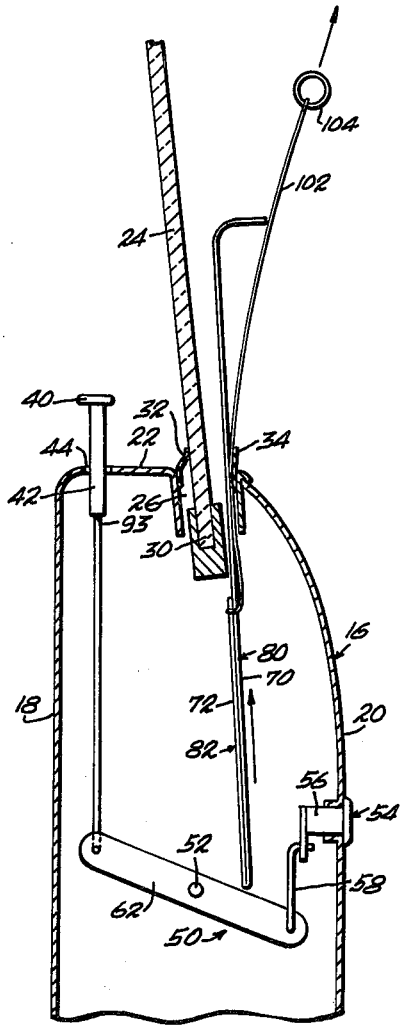
FIG. 3 is a view similar to FIG. 2 and illustrating the removal of the tool after use in unlocking an automobile door.

The tool shown in FIG. 1 and generally designated by the numeral 12 comprises a strip with an inside surface 70 and an outside surface 72 which strip is bent perpendicular to the longitudinal edges 74 and 76 forming a bend zone 78 and defining an operator length 80 or longer leg and a latch manipulating length 82, or shorter length, the latter of which terminates at a manipulator edge 84 which may be recessed as shown. The latch manipulator length is of a first predetermined length which is less than the length of the operator length. It is seen that the bent zone defines a normally included crotch angle 90 which is less than 90° but greater than 45° in the preferred embodiment. When the tool is inserted in the manner shown in FIG. 2, the inside surface of the strip on opposite sides of the bend zone will be in confronting engagement as shown in FIG. 3 and the tool may be slipped downwardly until the compression forces are released at which time the length 72 will move outwardly to the normal angle. Thereafter, the tool is lifted or raised until the edge 84 engages the lower end 93 of the latch operator and then the tool is lifted upwardly lifting the latch operator and unlocking the door because, by so doing, the lock mechanism is operated. Thereafter, the tool is again depressed downwardly and by pulling on the string 102 using the ring 104 on the end, the edge 84 which engage the latch operator may be pulled toward the longer length so that the shorter leg is in generally parallel relation with the main tool length and, thereafter, the same may be withdrawn, along the path indicated by the arrowed line in FIG. 3.

It is thus seen that there has been provided a simple and inexpensive tool which is adapted for unlocking a locked door from the outside without the need to resort to a key; and, thereafter, that the tool may be readily removed; and, also, that the unlocking operation may be accomplished without injury or damage to the vehicle.

While the instant invention has been shown and described in what is considered to be a preferred embodiment, it is recognized that departures may be made therefrom within the scope of this invention which is, therefore, not to be limited but it, rather, to be accorded the full scope of the following claims.

What is claimed is:

1. A tool for moving a latch operator to unlock a lock mechanism of a vehicle door having an inside and an outside surface and having a window opening defining a window ledge surface bounding the opening with a mouth entrance of slit-type for sliding passage of a window pane into an out of spanning relation of the opening and a slidable window pane sized to span the opening and having a lower edge at all times between the door surfaces, guide means connecting the window pane and the door and constraining the window pane to movement through the slit into and out of closing relation of the opening, the lower window ledge surface having a hole between the window pane and the inside door surface and the latch operator having an upper end at all times above the ledge surface and a lower end below the ledge surface and between the door surfaces, the latch operator being sized for vertical movement in said hole between an unlocked elevated position and a locked lower position, the lock mechanism being mounted between the door surface and including a lock cylinder and barrel means mounted to the door and having an exteriorly accessible keyhole to accommodate a key for turning the lock cylinder and movable means connecting the latch operator and the lock cylinder barrel means and including a force transmitting push rod connected to the lower end of said latch operator; and said tool comprising:

an elongate strip of spring steel having a main smooth, flat inside and an outside surface with longitudinally extending edges, said strip being bent back upon itself defining a bent zone across the strip perpendicular to the edges and an operator length on one side of the bent zone and a latch manipulating length on the other side of said bent zone, said operator length having an upper end and the zone adjacent said upper end comprising handle means on the upper end and said operator length being of a first predetermined length between the bent zone and said upper end, said latch manipulator length having an upper end defining an edge and being of a second predetermined length less than said first predetermined length, said bent zone defining a normal included crotch angle between the length of less than 90° and greater than 45° and said strip length being yieldable in response to a compressive force applied to the exterior surfaces to bring the inside surfaces into close adjacent generally parallel relation for slipping the bent zone and generally parallel lengths in the slit of the window ledge surface between the window pane and the exterior door surface and inserting the tool depthwise between the door surface a distance greater than said second predetermined length until said upper end of said manipulating length is beneath the lower edge of said window pane and the energy stored in said bent zone by said compressive force is released and said latch manipulating length moves to its normal position with said upper edge in engagement with said force transmitting push rod and said tool being adapted to be moved upwardly to bring the said edge at said upper end into engagement with the lower end of the latch operator member to lift the latch operator and unlock the door; and a tether string having a first end and means connecting the first end to the manipulator length adjacent said edge at said upper end to pull the upper end toward the inside surface of said operator length to apply a tension force to generally realign the lengths parallel to one another for lifting of the tool from between the window pane and the outside surface.

2. The tool as set forth in claim 1 wherein said handle means comprises a zone adjacent the upper end of said operator length being outturned away from said manipulator length.

3. The tool as set forth in claim 1 wherein said tether string is provided with a ring on the free end thereof.

* * * * *